US006074353A

United States Patent [19]

Helmer

[11] Patent Number: 6,074,353

[45] Date of Patent: Jun. 13, 2000

[54] DEVICE FOR CARESSING THE BODY

[76] Inventor: Yeoshua Helmer, 86 Hanoter St., Kiryat Haim, Israel

[21] Appl. No.: 09/082,377

[22] Filed: May 21, 1998

[30] Foreign Application Priority Data

May 21, 1997 [IL] Israel ..... 120877

[51] Int. Cl.[7] ..... A61H 7/00

[52] U.S. Cl. ..... 601/136; 601/101; 601/117

[58] Field of Search ..... 601/84–90, 93–103, 601/107–138

[56] References Cited

U.S. PATENT DOCUMENTS 2,148,661 2/1939 Thierer ..... 601/134
3,403,674 10/1968 Alimanestiano ..... 601/134
4,228,794 10/1980 Boller ..... 601/95
4,984,568 1/1991 Persaud ..... 601/122
5,016,617 5/1991 Tarlow et al. ..... 601/117

*Primary Examiner*—Glenn E. Richman
*Attorney, Agent, or Firm*—Lowe Hauptman Gopstein Gilman & Berner

[57] ABSTRACT

A device for caressing the body has strips of flexible soft material hanging from a horizontal support above the body. A motive source is used to move the horizontal support over the body so that the strips can contact the body with varying degrees of tactile sensitivity to caress, tickle, scratch, numb and create arousal sensations.

6 Claims, 2 Drawing Sheets

DEVICE FOR CARESSING THE BODY

FIELD OF THE INVENTION

The present invention generally relates to a device for caressing the body. More specifically the present invention relates to a device for caressing the body wherein strips made of flexible soft material in contact with the body are slid on the body.

BACKGROUND OF THIS INVENTION

Massage devices are well known for tactile stimulation and for muscle relaxation. In these massage devices there is not an identical result to that derived from the device according to the present invention, nor do vibratory massage device operate on the same tactile principle as the present invention (which slides material over the body's surface).

There are known methods using feathers and the like for caressing or tickling bodies, but their effectiveness is restricted to the skill of their operators. We know of no mechanical device operating on principles similar to the present invention, nor do we know of any mechanical device specifically intended to perform the function of caressing, tickling, or in like manner tactilly stimulating the body. In the device according to the present invention the mechanical action is programmable, and thus independent of the operator's skills.

SUMMARY OF THE INVENTION

The present invention relates to a device for caressing the body. The device according to the present invention is comprised of strips made of flexible soft material hanging from a horizontal support above the body, and means for sliding the strips on the body.

The specific tactile stimulation (caress) provided by the present invention depends on the choice of material used for the stripe, the kinematics program of the motion controller, and the total body surface area having contact with the strips (in a given motion cycle of the strips)

DETAILED DESCRIPTION OF THE INVENTION

Figure 1:
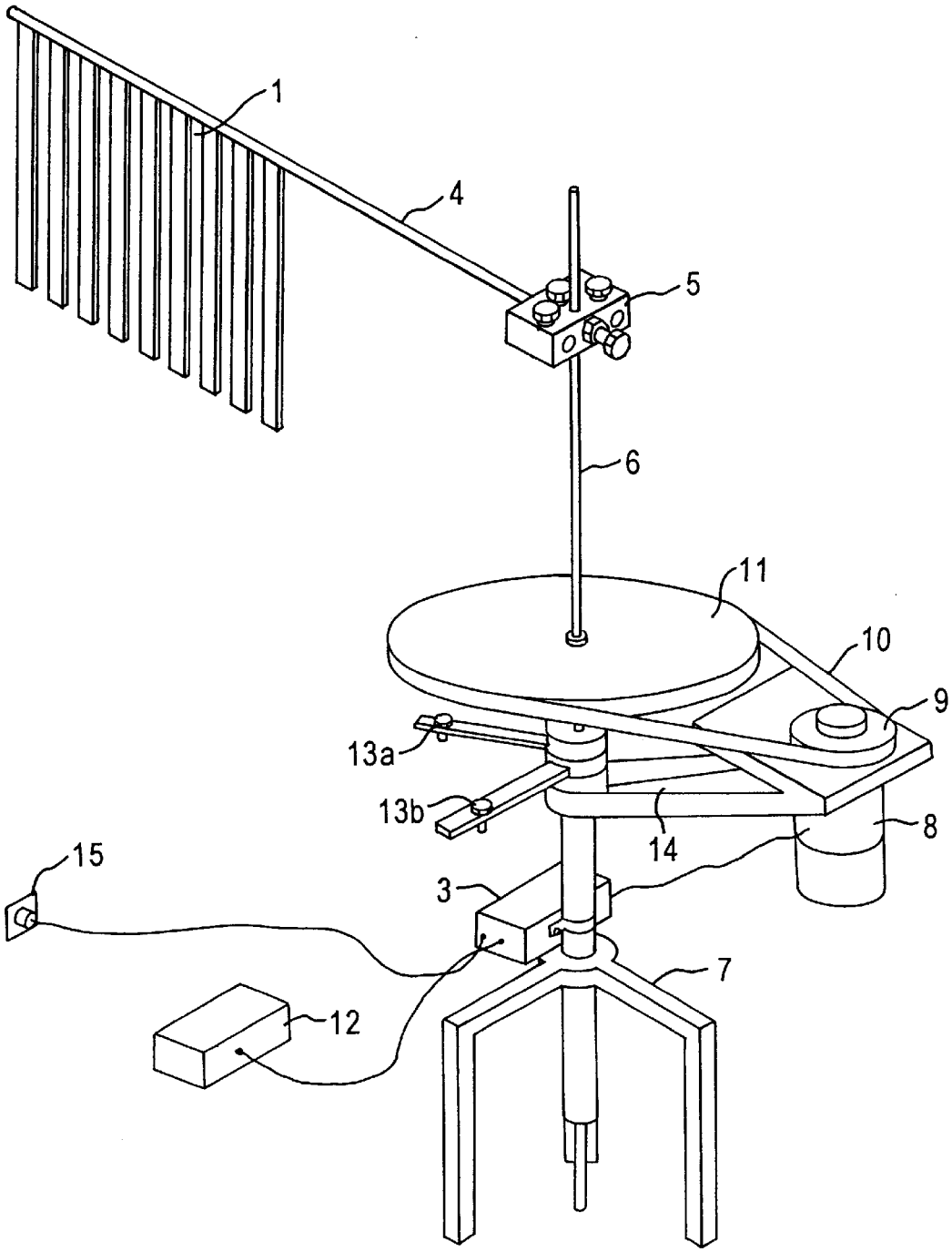

A "kinematic program" in this invention if a set of instructions or parameters which determine the mode of operation of the motion controller (in selecting the position, velocity, and/or acceleration) of the horizontal support. The horizontal support may be a rod of any profile or shape, such that the strips can be suspended therefrom during their motion.

The present invention relates to a device for caressing the body comprising of strips made of flexible soft material hanging from a horizontal support above the body, and means for moving and holding said horizontal support over the body.

The strips are made of at least one piece of material (preferably more than three strips, but according to one embodiment at least one strip), and the material is suspended from the horizontal support. The strips may be made of any soft flexible material such as feathers, cloth, leather netting, rope, flexible plastic, fur, paper, chain-mail, foil, wood, fiber glass, wool, rubber, carton, or any combination thereof. Functionally the same use is applied if the strips are one piece of material (a curtain) or many pieces of material. The strips may be of any profile or dimension sufficient for sliding on the body (surface area contact) and for hanging from the horizontal support.

The motion engine for moving the horizontal support is comprised of an electric motor, a gear and belt (or equivalent transmission) assembly for transferring and modifying the motion from said motor to a vertical axle, and said axle is supporting the affixed horizontal support. Thus the motion engine serves as a means for moving the horizontal support over the body.

Many distinctive kinematics programs can be used. Classes of kinematics programs for selecting specific temporary modifications of tactile sensitivity include caress, tickle, scratch, numb, and arouse. The following descriptions represent illustrative examples of members specific programs.

a caress-like: very slow continuous trips motion (using light weight strips). "

b. tickle-like: rapid small changes in the strings position each followed by a series of slower (damping)" oscillations or vibration and then by a motion pause (using light weight strips).

c. scratch-like: rapid oscillation strips motion (high frequency) superimposed onto slow oscillation strips notion (low frequency)—(using abrasive strips).

d. numb-like: continuous strips motion (using strips of homogeneous material).

e. two sped cycle: a two stage repeating program where the strips motion alternates between a lower and a higher velocity such that in stage one the strips motion is at the lower velocity (for a predetermined time interval), and in stage two the strips notion in at the higher velocity (for a predetermined time interval).

f, arouse-like: strips motion starting at very slow continuous speed and slowly increasing to a maximum speed, followed by a motion pause and a re-start of the same program (using light weight strips).

According to another embodiment of the device of the present invention, the mean for moving the horizontal support over the body is manually.

Figure 2:
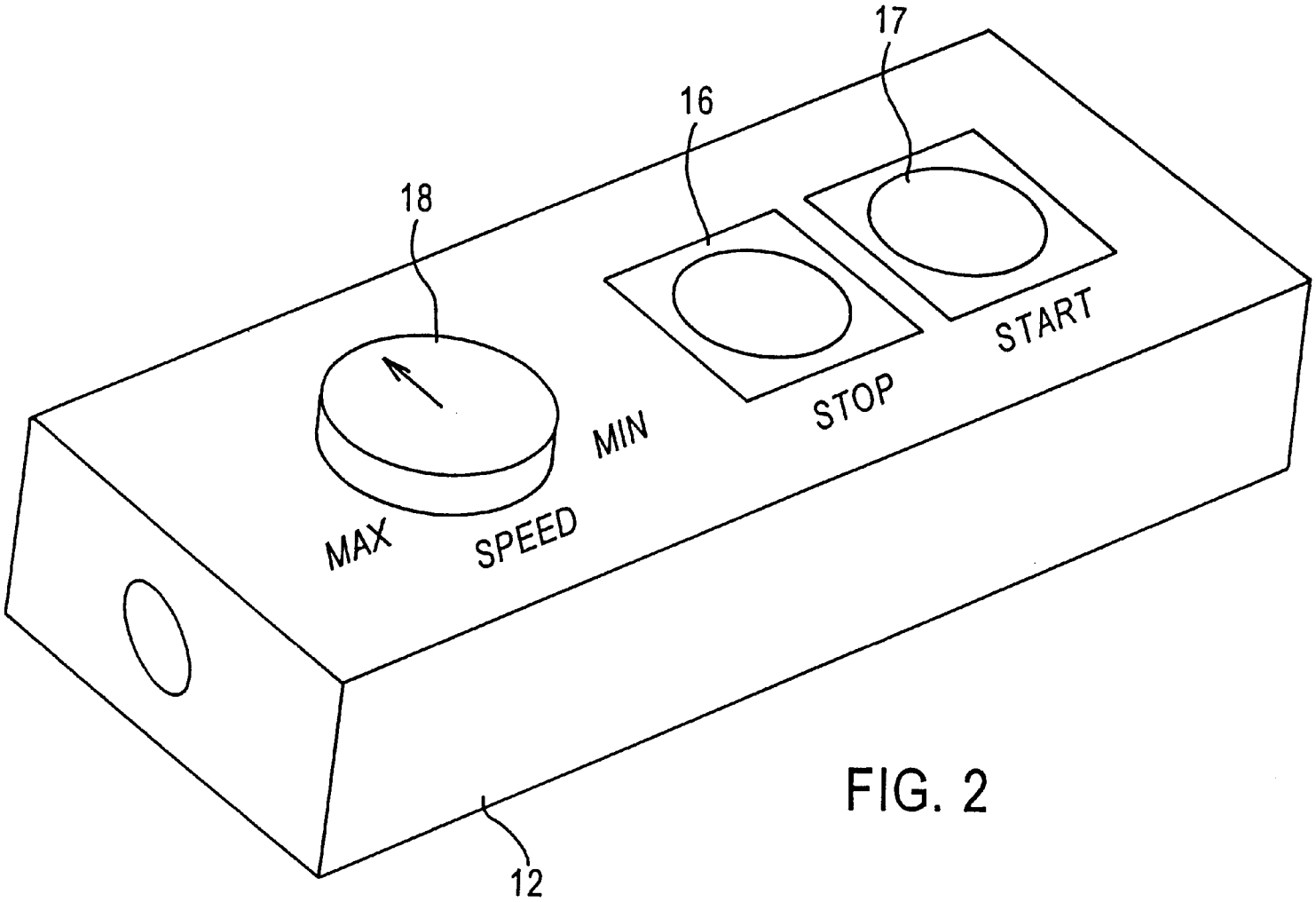

The present invention will be further described by FIGS. 1–2. These figures art solely intended to illustrate the preferred embodiment of the invention and are not intended to limit the scope of the invention in any manner.

FIG. 1 in an isometric illustration of the device for caressing the body.

FIG. 2 is an isometric illustration of a remote control box for use with the device for caressing the body.

FIG. 1 in an isometric illustration of the device for caressing the body. Strips (1) of flexible soft material, a motion engine, and a motion controller (3) are shown, flexible soft material hanging from a horizontal support rod (4). This horizontal support rod is attached to a vertical axle (6), and the connecting attachment (5) allows both the horizontal support rod to be extended (or retracted) from the vertical axle and the horizontal support rod to be affixed in a higher (or lower) position with respect to the vertical axle. The vertical axle rest on a floor stand (7) wherein the height can also be adjusted.

The motion engine is comprised of an electric motor (8), a gear (9) and belt (10) assembly for transferring and modifying the motion from the motor to the vertical axle (where the vertical axle in hold and rotated by a co axial gear (11)).

The specific direction of rotation of the motor and speed of rotation of the motor are determined by the motion controller (3). In the motion controller the current intensity and/or polarity are modified according to parameters sot by the operator on the remote control box (12), and according to a pro-set (or adjustable) angle limit for oscillation (which is here shown as two pins (13*a*) (13*b*) each mounted on arms co-axial with the vertical axle). These two pins actuate micro switches connected to the motion controller.

In actual operation, the operator selects the parameters of operation on the remote control box. This in turn causes the motion controller to open the flow of electricity from the mains (15) to the motor (via interface circuits as required). According to the specific characteristics of the current passing to the motor, the motor will turn clockwise or counter clockwise. This turning of the motor will in turn rotate the vertical axle which in turn moves the strips. The limit of the stress's motion is according to the two angle limiting pins.

FIG. 2 is an isometric illustration of a remote control box for use with the device for caressing the body. The remote control box (12) contains the means for the operator's interface with the motion controller, and thus the specific kinematics program is chosen. The operator selects the speed of the stress's motion using the speed knob (18) and then presses a start button (17). The selected speed will continue until the speed is changed or until the stop button (19) is pressed.

The remote control box shown here is for automatic kinematics program such as caress-like (MIN) and numb like (MAX). The names "caress-like" and "numb-like" may be applied to these kinematics program when strips of the appropriate texture are suspended from the horizontal support.

I claim:

1. A device for caressing a body, comprising a support member; plural strips made of flexible soft material hanging from the support member for positioning above the body; a motor connected to the support member for moving said support over the body; said support member including a vertical axle, a gear and belt assembly connected to the motor to move the vertical axle and thereby move the support member and strips, and further comprising a floor stand connected to support the vertical axle in relation to a floor surface.

2. A device for caressing the body according to claim 1, further comprising a motion controller connected to the motor to define the position, velocity, and acceleration of the support member.

3. A device for caressing the body according to claim 1 wherein the strips are made from material selected from a group consisting of feathers, cloth, leather, netting, rope, flexible plastic, fur, paper, chain-mail, foil, wood, fiber glass, wool, rubber, carton, or any combination thereof.

4. A device for caressing the body according to claim 1 wherein there are at least three strips.

5. The device of claim 1, wherein said motor is stationarily mounted in a fixed position relative to the support axle.

6. A device for caressing a body, comprising:

a support member; at least one strip made of flexible soft material hanging from the support member for positioning above the body; and a motor mounted at a stationary location and connected to the support member for moving the support member over the body while the motor remains at the stationary location, wherein said stationary member is connected to a floor support base for stationary positioning relative thereto and a vertical axle projects upward from the support base, said support member being attached to said vertical axle for motorized movement as a result of rotation of said axle about its rotational axis.

* * * * *